US007338756B2

(12) United States Patent
Zengerle et al.

(10) Patent No.: US 7,338,756 B2
(45) Date of Patent: Mar. 4, 2008

(54) METHOD OF PREPARATION OF DIRECT DISPERSIONS OF PHOTOGRAPHICALLY USEFUL CHEMICALS

(75) Inventors: Paul L. Zengerle, Rochester, NY (US); Richard K. Rothrock, Naples, NY (US); Jerrold N. Poslusny, Rochester, NY (US); Stephen P. Singer, Spencerport, NY (US); Peter P. Garrisi, Rochester, NY (US); Paul B. Merkel, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 488 days.

(21) Appl. No.: 10/692,535

(22) Filed: Oct. 24, 2003

(65) Prior Publication Data

US 2005/0089806 A1 Apr. 28, 2005

(51) Int. Cl.
*G03C 1/005* (2006.01)
*G03C 1/08* (2006.01)

(52) U.S. Cl. ..... 430/546; 430/543; 430/631; 430/642; 430/539

(58) Field of Classification Search ..... 430/539, 430/642, 546, 631
See application file for complete search history.

(56) References Cited

U.S. PATENT DOCUMENTS 2,322,027 A 6/1943 Jelley et al.
2,698,794 A 1/1955 Godowsky
2,787,544 A 4/1957 Godowsky et al.
2,801,170 A 7/1957 Vittum et al.
2,801,171 A 7/1957 Fierke et al.
2,949,360 A 8/1960 Julian
5,405,736 A 4/1995 Young
5,468,604 A * 11/1995 Zengerle et al. ..... 430/631
5,589,322 A * 12/1996 Lobo et al. ..... 430/449
5,624,467 A * 4/1997 Texter et al. ..... 23/295 R
5,998,120 A * 12/1999 Connelly et al. ..... 430/539
6,074,808 A 6/2000 Endo
6,103,460 A * 8/2000 Takahashi et al. ..... 430/546
6,107,017 A * 8/2000 Merkel et al. ..... 430/546
6,200,741 B1 * 3/2001 Stanley et al. ..... 430/543
6,220,925 B1 * 4/2001 Saito et al. ..... 430/546
6,645,712 B1 * 11/2003 Olijve et al. ..... 430/543
6,680,165 B1 1/2004 Poslusny et al.
6,824,941 B2 * 11/2004 Honan et al. ..... 430/96

OTHER PUBLICATIONS

Kamlet et al., "Linear Solvation Energy Relationships. 23. A Comprehensive Collection of the Solvochromatic Parameters, π, α, and β, and Some Methods for Simplifying the Generalized Solvatochromic Equation," J. Org. Chem., vol. 48, pp. 2877-2887 (1983).

* cited by examiner

*Primary Examiner*—Amanda C. Walke
(74) *Attorney, Agent, or Firm*—Andrew J. Anderson

(57) ABSTRACT

A process for making a direct dispersion of a photographically useful material comprising: mixing (i) an aqueous phase and (ii) a liquid organic phase under conditions of shear or turbulence to form a dispersion of the organic phase dispersed in the aqueous phase; wherein the liquid organic phase comprises one or more photographically useful materials and one or more organic solvents having a boiling point of at least 150° C., a molecular weight less than or equal to 300, and a solvatochromic parameter β value greater than or equal to 0.50, wherein the weight ratio of the sum of the solvents having a boiling point of at least 150° C., a molecular weight less than or equal to 300, and a solvatochromic parameter β value greater than or equal to 0.50 to the photographically useful materials does not exceed 0.25. The use of relatively low levels of specified high-boiling organic solvents enables the direct dispersion of hydrophobic photographically useful materials with low solubility in conventional primary photographic useful solvents without crystallization problems or excessive decomposition.

36 Claims, No Drawings

METHOD OF PREPARATION OF DIRECT DISPERSIONS OF PHOTOGRAPHICALLY USEFUL CHEMICALS

FIELD OF THE INVENTION

This invention relates to methods of making dispersions of photographically useful materials, dispersions made by such methods, and silver halide photographic materials incorporating such dispersions, and more specifically to photographic materials comprising direct dispersions made without using a removable auxiliary solvent.

BACKGROUND OF THE INVENTION

The use of aqueous dispersions of photographic couplers and other hydrophobic photographically useful compounds is known in the art. Dispersions are suspensions of an oil phase in an aqueous phase, used to alter the character of photographically useful chemicals so that they can be incorporated into an aqueous gelatin matrix. The incorporated materials are generally high molecular weight, hydrophobic, crystalline materials such as couplers, dyes, Dox scavengers, and UV absorbers. Generally, dispersions of hydrophobic photographically useful materials (PUMs) in aqueous solutions are prepared by homogenization of a liquid organic phase containing a photographically useful material into an aqueous solution containing a hydrophilic colloid such as gelatin and, optionally, a surface active material. Methods of dispersion preparation of photographically useful chemicals are well-known in the art and have been described in, e.g., U.S. Pat. Nos. 2,322,027, 2,698,794, 2,787,544, 2,801,170, 2,801,171, and U.S. Pat. No. 2,949,360.

Processes for homogenization of liquid organic phases frequently include the use of low boiling or at least partially water miscible auxiliary solvents, which auxiliary solvent is subsequently removed after homogenization by evaporating volatile solvent or washing water miscible solvents. Such auxiliary solvents facilitate combining couplers and/or any other hydrophobic dispersion components in a mixed solution, so that a dispersion with an oil phase of uniform composition is obtained. The solvent also lowers the viscosity of the oil solution, which allows the preparation of small-particle emulsified dispersions. The use of auxiliary solvent may also be used to form a liquid organic solution of a PUM for forming a dispersion where no permanent solvent is desired in the final dispersion. The use of auxiliary solvent, however, also presents several potential difficulties in the preparation of photographic dispersions and elements. Auxiliary solvents can cause severe coating defects if not removed before the coating operation. Also, it is not possible, due to thermodynamic considerations, to remove 100% of the auxiliary solvent from the dispersion. This may cause other deleterious effects such as enhancing the solubility and movement of the PUM, or aid in crystallization. Further, the steps of evaporating volatile solvent from an evaporated dispersion and washing a chill-set, washed dispersion often leads to final photographic dispersions with variable concentration, so that careful analysis is necessary to determine the actual concentration of the photographically useful compound in the dispersion. Volatile or water-soluble auxiliary solvents present health, safety, and environmental hazards, with risks of exposure, fire, and contamination of air and water. The cost can be significant for the solvent itself, as can be the costs of environmental and safety controls, solvent recovery, and solvent disposal.

Alternatively, PUMs may be "directly" homogenized or dispersed into an aqueous solution in the substantial absence of any auxiliary solvent (i.e., absence of such solvents beyond trace or impurity levels). In one such direct dispersion process, the hydrophobic components desired in the dispersion, e.g., coupler and permanent coupler solvent, are simply melted at a temperature sufficient to obtain a homogeneous oil solution. This is then emulsified or dispersed in an aqueous phase, typically containing gelatin and surfactant. The direct process also yields a dispersion with a known concentration of the photographically useful compound, based on the components added, with no variability due to evaporation or washing steps. It is much less complex and less expensive because no volatile or water-soluble auxiliary solvent removal step is required. Further, since no auxiliary solvent is used, there are no associated environmental concerns. Additionally, the absence of auxiliary solvents in the dispersion forming step generally allows for higher concentrations of permanent organic phase (comprising the photographically useful materials and any high boiling permanent organic solvent) in the resulting dispersion. Processing times are shorter and material yields are higher. There are no dispersion quality issues related to the presence of residual auxiliary solvent in the finished dispersion. In addition, direct dispersions typically have a lower propensity for the formation of large oil droplets, which can cause physical defects in photographic film. For these reasons, the direct dispersion method is typically preferred over evaporated and washed processes, as it usually provides higher quality at lower cost.

While the direct dispersion process may in general be preferred for the above reasons, there are potential problems with the use of direct dispersions. Since there is no auxiliary solvent used, it is often more difficult to completely dissolve the photographically useful material and avoid dispersion crystallization problems, especially with high-melting couplers. Higher oil phase temperatures and longer oil solution hold times are usually required, resulting in an increased propensity for coupler decomposition during oil phase preparation. This can lead to lower and more variable coupler concentrations and the formation of photographically harmful by-products, which can cause emulsion fog and speed losses. These problems limit the number of photographically useful materials which typically have been dispersed using the direct method. It would therefore be desirable to have an improved method of preparing direct dispersions of high-melting photographically useful materials without crystallization or decomposition problems, and without causing any deleterious effects on photographic performance or physical quality.

SUMMARY OF THE INVENTION

These and other objectives are achieved in accordance with the process of the invention, which comprises a process for making a direct dispersion of a photographically useful material comprising: mixing (i) an aqueous phase and (ii) a liquid organic phase under conditions of shear or turbulence to form a dispersion of the organic phase dispersed in the aqueous phase; wherein the liquid organic phase comprises one or more photographically useful materials and one or more organic solvents having a boiling point of at least 150° C., a molecular weight less than or equal to 300, and a solvatochromic parameter β value greater than or equal to 0.50, wherein the weight ratio of the sum of the solvents having a boiling point of at least 150° C., a molecular weight less than or equal to 300, and a solvatochromic parameter β value greater than or equal to 0.50 to the photographically useful materials does not exceed 0.25.

In another embodiment, the invention is directed towards dispersions obtained by the process of the invention. In a further embodiment, the invention is directed towards a photographic element comprising one or more light sensitive silver halide emulsion imaging layers having associated therewith a direct dispersion obtained by the process of the invention, wherein the coated level of solvents having a boiling point of at least 150° C., a molecular weight less than or equal to 300, and a solvatochromic parameter β value greater than or equal to 0.50 in any layer of the element is no greater than 200 mg/m$^2$.

DETAILED DESCRIPTION OF THE INVENTION

It has been found that hydrophobic, high-melting photographically useful materials with low solubility in conventional primary photographic useful solvents can be successfully dispersed using the direct process without crystallization problems or excessive decomposition by using the method of the present invention. This method employs relatively low levels of specified high-boiling, relatively low molecular weight organic solvents. Only certain classes of solvents are useful as the specified solvents employed in accordance with the invention, and we refer to such solvents herein as "super-solvents". In general, solvents that have a high hydrogen-bond-acceptor (HBA) strength are the most effective super-solvents. The solvatochromic parameter beta (β) scale, developed by Kamlet et al., has been used to quantify this property. The β parameter for a number of organic compounds, as well as reference procedures for its determination, e.g., are described in Kamlet et al., "Linear Solvation Energy Relationships. 23. A Comprehensive Collection of the Solvochromatic Parameters, π*, α, and β, and Some Methods for Simplifying the Generalized Solvatochromic Equation," J. Org. Chem., Vol. 48, pp. 2877-2887 (1983).

It is important to minimize the coated level of these specified solvents, particularly when dispersing dye image-forming couplers, to avoid photographic problems such as: reduced coupling reactivity, dye hue shifts, reduced dye stability, and poor raw stock keeping. Also, since these super-solvents are relatively hydrophilic compared to other more typically employed permanent coupler solvents, they have the ability to potentially migrate from one layer to another within a multilayer photographic element causing harmful effects there. Hence, these super-solvents are used at relatively low levels relative to the photographically useful material in accordance with the invention.

The process of the invention is generally applicable to forming aqueous dispersions of hydrophobic photographically useful materials (PUMs) which may be used at various locations throughout a photographic element. Photographically useful materials which may be dispersed in accordance with the invention include photographic couplers (including yellow, magenta and cyan image-forming couplers, colored or masking couplers, inhibitor-releasing couplers, and bleach accelerator-releasing couplers, dye-releasing couplers, etc.), UV absorbers, preformed dyes (including filter dyes), reducing agents (including oxidized developer scavengers and nucleators), stabilizers (including image stabilizers, stain-control agents, and developer scavengers), developing agents, development boosters, development inhibitors and development moderators, optical brighteners, lubricants, etc. The invention is particularly suitable for formation of direct dispersions of dye image-forming couplers, and in particular high melting (e.g., melting point greater than 90° C.) image-forming couplers.

After formation of a direct dispersion in accordance with the invention, the resulting dispersion may be incorporated in a photographic coating layer in accordance with known practices. Dispersions formed in accordance with the invention may be used in single color (including black and white) or multicolor photographic elements. Multicolor elements typically contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

In a particular embodiment, the invention is directed towards a photographic element comprising one or more light sensitive silver halide emulsion imaging layers having associated therewith a direct dispersion obtained by the process of the invention, wherein the coated level of solvents having a boiling point of at least 150° C., a molecular weight less than or equal to 300, and a solvatochromic parameter β value greater than or equal to 0.50 in any layer of the element is no greater than 200 mg/m$^2$, more preferably no greater than 100 mg/m$^2$. Restricting the total level of super-solvent in any particular layer of a photographic element in accordance with such embodiment helps minimize any detrimental photographic effects which might otherwise be associated with the use of such solvents. When the term "associated" is employed, it signifies that a reactive compound is in or adjacent to a specified layer where, during processing, it is capable of reacting with other components. Most typically, e.g., dye-forming coupler dispersions will be dispersed directly in a light sensitive layer of a photographic element.

In practicing the present invention, a hydrophobic PUM is melted with at least one or more high boiling organic super-solvents prior to homogenization. High boiling solvents have a boiling point sufficiently high, generally above 150 C at atmospheric pressure, such that they are not evaporated under normal dispersion making and photographic layer coating procedures. The mixture of the PUM with the high boiling solvents is termed the liquid organic (or oil) phase. Each super-solvent employed in the organic phase mixture of the dispersions prepared in accordance with the invention has (i) a boiling point of at least 150° C., (ii) a molecular weight less than or equal to 300 (more preferably less than or equal to 250), and (iii) a solvatochromic parameter β value greater than or equal to 0.50 (preferably at least 0.60, and more preferably at least 0.70). Further, the weight ratio of the sum of the super-solvents to photographically useful material in the organic phase does not exceed 0.25, and more preferably does not exceed 0.20.

Preferred super-solvents for use in accordance with the invention include amides, anilides, phosphate esters, phosphine oxides, sulfoxides, ureas and ketones which meet the boiling point, molecular weight, and β value requirements as defined above, and which may be represented by Formulas I through VI:

I

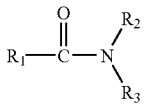

II

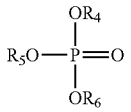

III

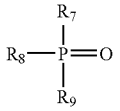

IV

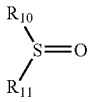

V

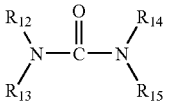

VI

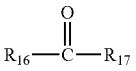

wherein $R_1$ through $R_{17}$ each independently represent hydrogen or a substituted or unsubstituted alkyl or aryl group. Preferably, $R_1$ through $R_{17}$ each independently represent a substituted or unsubstituted alkyl or aryl group. Alkyl groups may be straight chain or branched chain. Aryl groups include phenyl, annulated phenyl groups such as naphthalene, and aromatic heterocyclic groups such as pyridine. These substituents may optionally be attached to form closed rings.

In a preferred embodiment of Formula I, $R_1$ is alkyl or aryl, $R_2$ is alkyl, and $R_3$ is alkyl or aryl, wherein the total number of carbon atoms contained in $R_1$, $R_2$, and $R_3$ is less than 20. More preferred is where $R_1$ is a straight chain alkyl or aryl group, $R_2$ is a straight chain alkyl group, and $R_3$ is straight chain alkyl or aryl, such as where the compound of Formula I is, e.g., N,N-diethylbutyramide, N,N-diethyl-m-toluamide, or N-butylacetanilide. Also more preferred is where $R_1$ combines with $R_2$ or $R_3$ to form a closed ring, such as where the compound of Formula I is, e.g., N-methylpyrrolidone.

In Formula II, $R_4$, $R_5$ and $R_6$ are preferably alkyl or aryl, wherein the total number of carbon atoms contained in $R_4$, $R_5$, and $R_6$ is less than 15. More preferred is an alkyl group and most preferred is a straight chain alkyl group, such as where the compound of Formula II is, e.g., trimethylphosphate or triethylphosphate.

In Formula III, $R_7$, $R_8$ and $R_9$ are preferably alkyl or aryl, wherein the total number of carbon atoms contained in $R_7$, $R_8$ and $R_9$ is less than 20. More preferred is an alkyl group and most preferred is a straight chain alkyl group, such as where the compound of Formula III is, e.g., trimethylphosphine oxide or triethylphosphine oxide.

In Formula IV, $R_{10}$ and $R_{11}$ are preferably alkyl or aryl, wherein the total number of carbon atoms contained in $R_{10}$ and $R_{11}$ is less than 19. More preferred is an alkyl group and most preferred is a straight chain alkyl group, such as where the compound of Formula IV is, e.g., dimethylsulfoxide or di-n-butylsulfoxide.

In Formula V, $R_{12}$, $R_{13}$, $R_{14}$, and $R_{15}$ are preferably alkyl or aryl, wherein the total number of carbon atoms contained in $R_{12}$, $R_{13}$, $R_{14}$, and $R_{15}$ is less than 20. More preferred are straight chain alkyl groups and/or aryl groups, such as where the compound of Formula V is, e.g., tetramethylurea or 1,3-dimethyl-1,3-diphenylurea.

In Formula VI, $R_{16}$ and $R_{17}$ are preferably alkyl or aryl, wherein the total number of carbon atoms contained in $R_{16}$ and $R_{17}$ is less than 23. More preferred is where $R_{16}$ and/or $R_{17}$ is a cycloalkyl group and/or an aryl group and most preferred is where $R_{16}$ and $R_{17}$ combine to form an aliphatic closed ring, such as where the compound of Formula VI is, e.g., cyclohexanone or cyclopentanone.

It is understood throughout this specification that any reference to a substituent by the identification of a group containing a substitutable hydrogen, unless otherwise specifically stated, shall encompass not only the substituent's unsubstituted form, but also its form substituted with any other photographically useful substituents. For example, each such substitutable group can be substituted with one or more photographically acceptable substituents, such as those selected from an alkyl group, an aryl group, a heterocyclic group, an alkoxy group (e.g., methoxy, 2-methoxyethoxy), an aryloxy group (e.g., 2,4-di-tert-amyl phenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amido group (e.g., acetylamino, methanesulfonylamino, dipropylsulfamoylamino), a carbarnoyl group (e.g., dimethylcarbamoyl, ethylcarbamoyl), a sulfamoyl group (e.g., butylsulfamoyl), an imido group (e.g., succinimido, hydantoinyl), a ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxy group, a cyano group, a carboxy group, a nitro group, a sulfo group, and a halogen atom. Usually the substituent will have less than 30 carbon atoms and typically less than 20 carbon atoms.

While the use of super-solvents having relatively low molecular weight and relatively high solvatochromic parameter β values has been typically avoided as such solvents may result in deleterious effects in photographic performance or physical quality, especially with respect to dispersion of image-forming couplers which need to be coated at relatively high levels in photographic elements, the use of such super-solvents as defined above at relatively low levels as described in the present invention has been surprisingly found to enable the preparation of low cost, high yield, environmentally friendly direct dispersions for silver halide photographic materials, which provide improved manufacturing efficiency without causing any deleterious effects on photographic performance or physical quality.

In accordance with a preferred embodiment, the liquid organic phase of the direct dispersions obtained in accordance with the invention comprises a combination of a relatively lower level of super-solvent as defined above and a relatively higher level of a primary solvent distinct from the defined super-solvents, which may be used to provide desired photographic properties. In such embodiment, the combination of organic solvents consists essentially of one or more primary permanent high-boiling solvents and one or more high-boiling super solvents as defined above, where each primary solvent employed in the organic phase mixture of the dispersions has a boiling point of at least 150° C. and either (a) a molecular weight of greater than 300, (b) a solvatochromic parameter β value less than 0.50, or (c) a molecular weight of greater than 300 and a solvatochromic parameter β value less than 0.50, and where the weight ratio of the sum of the primary permanent solvents to the sum of the super-solvents is greater than 1, more preferably at least 2, even more preferably at least 3, and most preferably at least 4. Such combination of solvents enables higher overall levels of high-boiling solvents to be employed in the direct dispersions to provide desired photographic properties, while still limiting the amount of super-solvent employed. Primary solvents employed in the direct dispersions prepared in accordance with such embodiment of the invention may be selected from any conventional organic solvents meeting such criteria.

Non-limiting examples of primary permanent high boiling organic solvents having sufficiently high molecular weight and/or sufficiently low β value that may be used include the following: Phthalic acid alkyl esters such as diundecyl phthalate, dibutyl phthalate, bis-2-ethylhexyl phthalate, and dioctyl phthalate, phosphoric acid esters of molecular weights greater than 300 such as tricresyl phosphate, tris-2-ethylhexyl phosphate, and tris-3,5,5-trimethylhexyl phosphate, citric acid esters such as tributylcitrate and tributyl acetylcitrate, 1,4-cyclohexyldimethylene bis(2-ethylhexanoate), benzoic acid esters such as phenethyl benzoate, aliphatic amides of molecular weights greater than 300 such as N,N-dibutyldodecanamide, mono and polyvalent alcohols of molecular weight greater than 300 such as glyceryl monooleate, and aliphatic dioic acid alkyl esters such as dibutyl sebacate and other diesters of the formula R—$(CH_2)_m$—R' wherein R and R' each represent an alkoxycarbonyl group containing not more than 8 carbon atoms and m is an integer of from 1 to 10. Preferred primary solvents for use in the invention are the phthalic acid alkyl esters, phosphate esters of molecular weights greater than 300, benzoic acid esters and aliphatic dioic acid alkyl esters, which can be used alone or in combination with one another or with other primary coupler solvents.

Primary solvents are preferably used at wt ratios of from 0.1:1 to 10:1 relative to the wt of dispersed photographically useful material in the direct dispersions prepared in accordance with the invention, more preferably at wt ratios of from 0.25:1 to 5:1, and most preferably at wt ratios of from 0.25:1 to 2:1. Total levels of coupler solvents employed in the direct dispersion of the invention are preferably maintained at as low a level as required to provide desired photographic properties, as higher coated levels of solvents requires a concomitant increase in gelatin levels, both of which contribute to increased material cost, lower image acutance, and degraded physical quality.

It is preferable to include a hydrophilic colloid and surfactants in the aqueous phase of the dispersions of the invention. The aqueous phase of the dispersions preferably comprise gelatin as a hydrophilic colloid. This may be gelatin or a modified gelatin such as acetylated gelatin, phthalated gelatin, oxidized gelatin, deionized gelatin, etc. Gelatin may be base-processed, such as lime-processed gelatin, or may be acid-processed, such as acid processed ossein gelatin. Other hydrophilic colloids may also be used, such as a water soluble polymer or copolymer including, but not limited to poly(vinyl alcohol), partially hydrolyzed poly(vinylacetate-co-vinyl alcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The surfactant is preferably an anionic or nonionic surfactant, including fluorosurfactants. For purposes of this invention, a surfactant is a surface active material which is capable of depressing the surface tension of distilled water by at least 20 dynes/cm at its critical micelle concentration at 25 C. Anionic surface active agents preferably have the —$SO_3^-$ or —$OSO_3^-$ moiety. Preferred anionic surface active agents include naphthalenesulfonic acids, sulfosuccinic acids, alkylbenzenesulfonic acids, alylsulfonates, alkylsulfates and alkylbenzenesulfonates. Preferred nonionic surface active agents include polyol compounds, and compounds of the formula R—O—$(CH_2CH_2O)_nH$ where R is alkyl, aryl or aralkyl and n is from 5 to 30. A suitable amount of the surface active agent is up to 50% based on the gelatin used, preferably up to 20% and most preferably up to 10%. The aqueous solution containing the gelatin and any surfactant is termed the aqueous phase of the dispersion. Ratios of surfactant to liquid organic phase solution typically are in the range of 0.5 to 25 wt. % for forming small particle photographic dispersions, which ratios are also useful for the invention dispersions.

Dispersions in accordance with the invention may also contain further components conventionally employed in photographic dispersions. Devices suitable for the high-shear or turbulent mixing of the dispersions of the invention include those generally suitable for preparing submicron photographic emulsified dispersions. These include but are not limited to blade mixers, colloid mills, homogenizer devices in which a liquid stream is pumped at high pressure through an orifice or interaction chamber, sonication, Gaulin mills, homogenizers, blenders, microfluidizers, rotor stator devices, etc. More than one type of device may be used to prepare the dispersions. For the purposes of this invention, "high shear or turbulent conditions" defines shear and turbulence conditions sufficient to generate a small particle photographic dispersion with an average particle size of less than about 1 micrometer. Dispersion particles formed in accordance with the invention preferably have an average particle size of less than 1 micrometers, generally from about 0.02 to 1 microns, more preferably from about 0.02 to 0.5 micron.

In accordance with preferred embodiments, the process of the invention is used to form aqueous dispersion of image dye-forming couplers. Couplers that form cyan dyes upon reaction with oxidized color developing agents include those described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156-175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429,3,758,309, 4,540,654, and "Farbkuppler-eine LiteratureUbersicht," published in Agfa Mitteilungen, Band III, pp. 126-156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112-126 (1961). Such couplers are typically open chain ketomethylene compounds.

Dispersions of the invention are preferably used in a typical multicolor photographic element, which may comprise a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. Useful coated levels of dye-forming couplers range from about 0.1 to about 5.00 g/sq m, or more typically from 0.2 to 3.00 g/sq m. Such an element can contain additional layers, such as filter layers, interlayers, overcoat layers, subbing layers, and the like, containing dispersions prepared in accordance with the invention.

If desired, the photographic element can be used in conjunction with an applied magnetic layer as described in *Research Disclosure*, November 1992, Item 34390 published by Kenneth Mason Publications, Ltd., Dudley Annex, 12a North Street, Emsworth, Hampshire P010 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure*, June 1994, Item 36230, provides suitable embodiments. It is further contemplated that the dispersions of the invention may also be advantageously used with the materials and processes described in an article titled "Typical and Preferred Color Paper, Color Negative, and Color Reversal Photographic Elements and Processing," published in Research Disclosure, February 1995, Volume 370.

In the following discussion of suitable materials for use in the emulsions and elements of this invention, reference will be made to *Research Disclosure*, September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Suitable silver halide emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure*, Item 37038, February 1995.

The photographic element can be incorporated into exposure structures intended for repeated use or exposure structures intended for limited use, variously referred to by names such as "single use cameras", "lens with film", or "photosensitive material package units".

The method of practicing the present invention and the above mentioned benefits are demonstrated in the following non-limiting illustrative examples, in which the following photographically useful materials are used:

M1

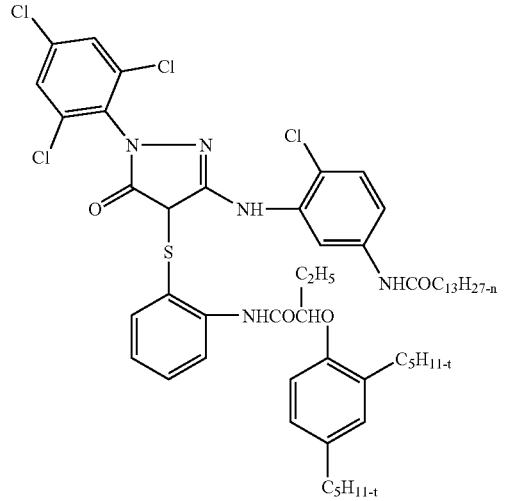

C1

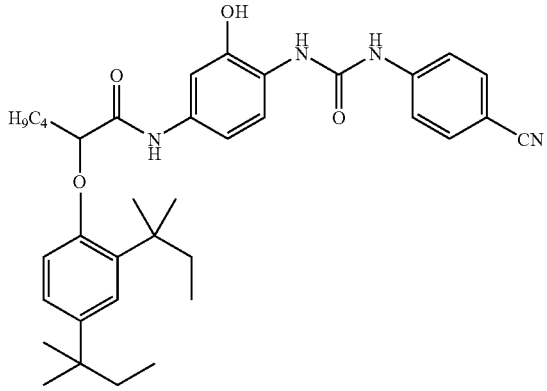

C2

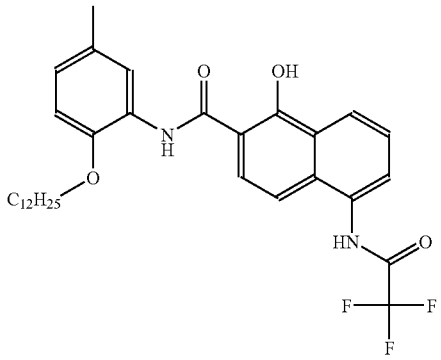

-continued

C3

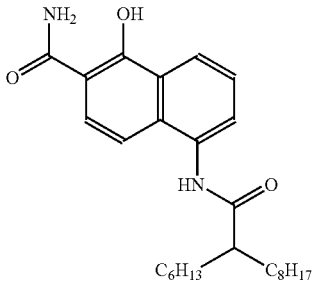

C4

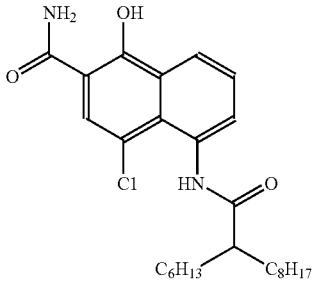

C5

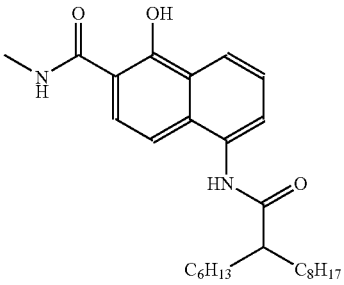

EXAMPLE 1

2.00 g of a magenta dye-forming coupler M1 was added to 2.00 g of a primary high-boiling solvent tricresylphosphate and 0.30 g of another additional solvent (either a solvent of Formulas I through VI having a β parameter greater than or equal to about 0.50 in accordance with the invention, or a comparison solvent having a lower β parameter) in a test tube at room temperature. The tubes were then immersed in a silicone oil bath placed on a hot plate at room temperature and the mixtures were gradually heated with manual stirring. The liquidus temperature (L.T.) at which the coupler completely dissolves in the solvent blend was determined by visual observation. Results are summarized in Table I.

TABLE I

Effect of Solvent Beta Parameter on M1 Solubility

| Additional Solvent | Beta Parameter (β) | Mol Wt | B.P. (° C.) | L.T. (° C.) |
|---|---|---|---|---|
| No Additional Solvent (Comp) | — | — | — | 160 |
| Cyclohexane (Comp) | 0.00 | 84.2 | 81 | 156 |
| Heptane (Comp) | 0.00 | 100.2 | 98 | 157 |
| Toluene (Comp) | 0.11 | 92.2 | 111 | 145 |
| Phenylbenzoate (Comp) | 0.39 | 198.2 | 314 | 152 |
| Methylbenzoate (Comp) | 0.39 | 136.2 | 200 | 148 |
| Ethylbenzoate (Comp) | 0.41 | 150.2 | 213 | 147 |

TABLE I-continued

Effect of Solvent Beta Parameter on M1 Solubility

| Additional Solvent | Beta Parameter (β) | Mol Wt | B.P. (° C.) | L.T. (° C.) |
|---|---|---|---|---|
| Benzophenone (Comp) | 0.44 | 182.2 | 306 | 149 |
| Ethylacetate (Comp) | 0.45 | 88.1 | 77 | 158 |
| Cyclohexanone (Inv) | 0.53 | 98.2 | 156 | 140 |
| Dimethylformamide (Inv) | 0.69 | 73.1 | 152 | 125 |
| Diphenylsulfoxide (Inv) | 0.70 | 202.3 | 206 | 142 |
| Methylphenylsulfoxide (Inv) | 0.71 | 140.2 | Solid | 134 |
| Dimethylsulfoxide (Inv) | 0.76 | 78.1 | 189 | 118 |
| N,N-Dimethylacetamide (Inv) | 0.76 | 87.1 | 164 | 115 |
| Triethylphosphate (Inv) | 0.77 | 182.2 | 215 | 109 |
| N-methylpyrrolidone (Inv) | 0.77 | 99.1 | 202 | 118 |
| N,N-Diethylacetamide (Inv) | 0.78 | 115.2 | 182 | 129 |
| Tetramethylurea (Inv) | 0.80 | 116.2 | 177 | 130 |
| Di-n-butyl sulfoxide (Inv) | 0.83 | 162.3 | 250 | 134 |
| Trimethylphosphine oxide (Inv) | 1.02 | 92.1 | Solid | 93 |
| Triethylphosphine oxide (Inv) | 1.05 | 134.2 | 243 | 109 |

The results clearly indicate that greater useful reductions in liquidus temperature (in this example, greater than 15° C. below the control with no additional solvent) were obtained with solvents of Formulas I through VI having a β parameter greater than or equal to about 0.50 relative to other solvents having a low β parameter value. Such lower liquidus temperatures facilitate preparation of direct dispersions in accordance with the invention. All of the high β solvents have boiling points greater than or equal to 150° C., required for the formation of direct dispersions.

EXAMPLE 2

2.00 g of a cyan dye-forming coupler C1 was added to 2.00 g of a primary high-boiling solvent dibutylsebacate and 0.35 g of another additional solvent (either a solvent of Formulas I through VI having a β parameter greater than or equal to about 0.50 in accordance with the invention, or a comparison solvent having a lower β parameter) in a test tube at room temperature. The tubes were then immersed in a silicone oil bath placed on a hot plate at room temperature and the mixtures were gradually heated with manual stirring. The liquidus temperature (L.T.) at which the coupler completely dissolves in the solvent blend was determined by visual observation. Results are summarized in Table II.

TABLE II

Effect of Solvent Beta Parameter on C1 Solubility

| Additional Solvent | Beta Parameter (β) | Mol Wt | B.P. (° C.) | L.T. (° C.) |
|---|---|---|---|---|
| No Additional Solvent (Comp) | — | — | — | 162 |
| Cyclohexane (Comp) | 0.00 | 84.2 | 81 | >150 |
| Heptane (Comp) | 0.00 | 100.2 | 98 | >150 |
| Toluene (Comp) | 0.11 | 92.2 | 111 | 150 |
| Phenylbenzoate (Comp) | 0.39 | 198.2 | 314 | 151 |
| Methylbenzoate (Comp) | 0.39 | 136.2 | 200 | 148 |
| Ethylbenzoate (Comp) | 0.41 | 150.2 | 213 | 158 |
| Benzophenone (Comp) | 0.44 | 182.2 | 306 | 149 |
| Ethylacetate (Comp) | 0.45 | 88.1 | 77 | 150 |
| Cyclohexanone (Inv) | 0.53 | 98.2 | 156 | 105 |
| Dimethylformamide (Inv) | 0.69 | 73.1 | 152 | 82 |
| Diphenylsulfoxide (Inv) | 0.70 | 202.3 | 206 | 146 |
| Methylphenylsulfoxide (Inv) | 0.71 | 140.2 | Solid | 97 |
| Dimethylsulfoxide (Inv) | 0.76 | 78.1 | 189 | 80 |
| N,N-Dimethylacetamide (Inv) | 0.76 | 87.1 | 164 | 80 |
| Triethylphosphate (Inv) | 0.77 | 182.2 | 215 | 108 |
| N-methylpyrrolidone (Inv) | 0.77 | 99.1 | 202 | 84 |

TABLE II-continued

Effect of Solvent Beta Parameter on C1 Solubility

| Additional Solvent | Beta Parameter (β) | Mol Wt | B.P. (° C.) | L.T. (° C.) |
|---|---|---|---|---|
| N,N-Diethylacetamide (Inv) | 0.78 | 115.2 | 182 | 92 |
| Tetramethylurea (Inv) | 0.80 | 116.2 | 177 | 94 |
| Di-n-butyl sulfoxide (Inv) | 0.83 | 162.3 | 250 | 100 |
| Trimethylphosphine oxide (Inv) | 1.02 | 92.1 | Solid | 101 |
| Triethylphosphine oxide (Inv) | 1.05 | 134.2 | 243 | 103 |

The results clearly indicate that greater useful reductions in liquidus temperature (in this example, greater than 15° C. below the control with no additional solvent) were obtained with solvents of Formulas I through VI having a β parameter greater than or equal to about 0.50 relative to other solvents having a low β parameter value. Such lower liquidus temperatures facilitate preparation of direct dispersions in accordance with the invention. All of the high β solvents have boiling points greater than or equal to 150° C., required for the formation of direct dispersions.

EXAMPLE 3

2.00 g of magenta coupler M1 was added to 2.00 g of primary high-boiling solvent tricresylphosphate and 0.30 g of another additional solvent Formula I in a test tube at room temperature. The tubes were then immersed in a silicone oil bath placed on a hot plate at room temperature and the mixtures were gradually heated with manual stirring. The liquidus temperature (L.T.) at which the coupler completely dissolves in the solvent blend was determined by visual observation. Results are summarized in Table III.

TABLE III

Effect of Solvent Molecular Weight on M1 Solubility

| Additional Solvent | Mol Wt | B.P. (° C.) | L.T. (° C.) |
|---|---|---|---|
| N,N-Dimethylacetamide (Inv) | 87.1 | 164 | 118 |
| N,N-Diethylacetamide (Inv) | 115.2 | 182 | 127 |
| N,N-Dimethylbutyramide (Inv) | 115.2 | 185 | 128 |
| N,N-Diethylbutyramide (Inv) | 143.3 | | 133 |
| N,N-Diethyl-m-toluamide (Inv) | 191.3 | 147 (7 mm) | 138 |
| Dimethyldodecanamide (Inv) | 227.3 | | 139 |
| Diethyldodecanamide (Inv) | 255.4 | 166 (2 mm) | 141 |
| Dipropyldodecanamide (Inv) | 283.5 | | 144 |
| Dibutyldodecanamide (Comp) | 311.6 | 365 | 146 |
| No Additional Solvent (Comp) | — | — | 160 |

The results show that higher liquidus temperatures were required to dissolve the coupler as molecular weight increased for a homologous series of aliphatic amides of Formula I. While the β parameter values are not reported for each additional solvent, such aliphatic amides will have such values greater than 0.50. These results indicate that greater useful reductions in liquidus temperature (in this example, greater than 15° C. below the control with no additional solvent) were obtained with high β parameter solvents having a molecular weight less than or equal to 300.

EXAMPLE 4

2.00 g of magenta coupler M1 was added to 2.00 g of primary high-boiling solvent tricresylphosphate and 0.30 g of another additional solvent solvent (either a solvent of Formulas I through VI in accordance with the invention, or a comparison solvents) in a test tube at room temperature. The tubes were then immersed in a silicone oil bath placed on a hot plate at room temperature and the mixtures were gradually heated with manual stirring. The liquidus temperature (L.T.) at which the coupler completely dissolves in the solvent blend was determined by visual observation. Results are summarized in Table IV.

TABLE IV

Effect of Other Additional Solvents on M1 Solubility

| Additional Solvent | Mol Wt | B.P. (° C.) | L.T. (° C.) |
|---|---|---|---|
| No Additional Solvent (Comp) | — | — | 160 |
| Diethyladipate (Comp) | 216.3 | 251 | 147 |
| Dimethylphthalate (Comp) | 194.2 | 284 | 150 |
| Dimethylsuberate (Comp) | 202.3 | 268 | 150 |
| 2-Ethoxyethylacetate (Comp) | 132.2 | 156 | 150 |
| Octylacetate (Comp) | 172.3 | 210 | 147 |
| Di-t-butylmalonate (Comp) | 216.3 | 251 | 148 |
| N-Butylbenzoate (Comp) | 178.2 | 250 | 148 |
| N-Hexylbenzoate (Comp) | 206.3 | 272 | 148 |
| 2-Phenethylacetate (Comp) | 164.2 | 233 | 148 |
| N-Butylacetanilide (Inv) | 191.3 | 281 | 139 |
| N-Methylformanilide (Inv) | 135.2 | 243 | 138 |
| Trimethylphosphate (Inv) | 140.1 | 197 | 137 |
| Tri-n-propylphosphate (Inv) | 224.2 | 252 | 144 |
| Tri-isopropylphosphate (Inv) | 224.2 | 218 | 143 |
| 2,4-Dimethylacetanilide (Inv) | 163.2 | Solid | 140 |
| 2,6-Dimethylacetanilide (Inv) | 163.2 | Solid | 140 |
| 1,3-Dimethylurea (Inv) | 88.1 | 268 | 144 |
| 1,3-Dimethyl-1,3-Diphenylurea (Inv) | 240.3 | 350 | 120 |

This example contains results for many high-boiling solvents encompassing a wide range of molecular weights. The results indicate that the anilides, phosphate esters, and ureas employed in accordance with the invention are much more effective at lowering the liquidus temperature than the comparison alkyl- and aryl-substituted esters. While the β parameter values are not reported for each additional solvent, those designated as Inv will have such values greater than 0.50, while those designated as Comp will have values lower than 0.50.

EXAMPLE 5

0.50 g of cyan coupler C2 was added to 0.50 g of primary high-boiling solvent tricresylphosphate with and without 0.10 g of N-Butylacetanilide (solvent of Formula I) in separate test tubes at room temperature. Similar mated pairs were made with cyan couplers C3, C4, and C5. The tubes were then immersed in a silicone oil bath placed on a hot plate at room temperature and the mixtures were gradually heated with manual stirring. The liquidus temperature (L.T.) at which the coupler completely dissolves in the solvent blend was determined by visual observation. Results are summarized in Table V.

TABLE V

Effect of Super-Solvent on Cyan Coupler Solubility

| Coupler | Super-Solvent | L.T. (° C.) |
|---|---|---|
| C-2 | — (Comp) | 150 |
| C-2 | N-Butylacetanilide (Inv) | 140 |
| C-3 | — (Comp) | 144 |

TABLE V-continued

Effect of Super-Solvent on Cyan Coupler Solubility

| Coupler | Super-Solvent | L.T. (° C.) |
|---|---|---|
| C-3 | N-Butylacetanilide (Inv) | 128 |
| C-4 | — (Comp) | 150 |
| C-4 | N-Butylacetanilide (Inv) | 138 |
| C-5 | — (Comp) | 148 |
| C-5 | N-Butylacetanilide (Inv) | 132 |

In each case, the presence of a super-solvent in accordance with the invention resulted in a substantial lowering of the coupler dissolution temperature.

EXAMPLE 6

30.0 g of cyan coupler C1 was dissolved in 30.0 g of primary high-boiling solvent dibutylsebacate. This oil phase solution was then added to an aqueous phase solution consisting of 40.0 g Type IV gelatin, 20.0 g of a 10 wt % solution of Alkanol XC (Dupont), 0.7 g of a 0.7 wt % solution of Kathon LX (Rohm & Haas), and 379.3 g of distilled water. This mixture was pre-mixed using a Brinkman rotor-stator device at 5000 rpm for 1 min at 80° C. and then passed two times through a Microfluidizer M-110F at 5000 psi at 80° C. to form Dispersion A, which consisted of 6.0% coupler and 8.0% gel. Dispersions B through I were similarly prepared except that they additionally employed 6.0 g of either a super-solvent of Formulae I-V or a comparison solvent in the oil phase and 373.3 g of distilled water in the aqueous phase. The temperatures required for dissolving the coupler in the oil phase solution and the color of the resulting dispersions are given in Table VI.

TABLE VI

Liquidus Temperatures and Appearance of C1 Dispersions

| Dispersion | Super-Solvent | L.T. (° C.) | Color |
|---|---|---|---|
| A (Comp) | — | 160 | Pink |
| B (Comp) | Ethylbenzoate | 155 | Pink |
| C (Inv) | N-Butylacetanilide | 105 | White |
| D (Inv) | Triethylphosphate | 100 | White |
| E (Inv) | Trimethylphosphine oxide | 101 | White |
| F (Inv) | Dimethylsulfoxide | 80 | White |
| G (Inv) | Tetramethylurea | 90 | White |
| H (Inv) | N,N-Dimethylacetamide | 80 | White |
| I (Inv) | N,N-Diethyl-m-toluamide | 100 | White |

The temperatures required to dissolve the coupler were substantially lower using the super-solvents of the present invention. The pink color of the comparison dispersions is indicative of the presence of coupler decomposition products due to the excessively high oil phase temperatures employed.

EXAMPLE 7

Dispersion J and K were prepared similarly as Dispersion C of Example 6 employing N-Butylacetanilide as added super-solvent, except Dispersion J used 15.0 g of the super-solvent in the oil phase and 364.3 g of distilled water in the aqueous phase, and Dispersion K used 30.0 g of the super-solvent in the oil phase and 349.3 g of distilled water in the aqueous phase.

TABLE VIIa

Liquidus Temperatures and Appearance of C1 Dispersions

| Dispersion | N-Butylacetanilide:C1 Wt Ratio | L.T. (° C.) | Color |
|---|---|---|---|
| A (Comp) | — | 160 | Pink |
| C (Inv) | 1:5 | 105 | White |
| J (Comp) | 1:2 | 98 | White |
| K (Comp) | 1:1 | 88 | White |

To demonstrate the effects of high levels of super-solvents, dispersions A, C, J and K were coated on a cellulose acetate support as described below.

| |
|---|
| Overcoat Layer comprising Gelatin (2691 mg/m$^2$) and 1,1'-(methylenebis(sulfonyl))bis-ethene hardener (1.8% of total gel) |
| Light-sensitive EmulsionLayer comprising Red sensitive AgBrI Emulsion (800 mg/m$^2$), Cyan Coupler C1 dispersed as described above (359.4 mg/m$^2$), Gelatin (1508 mg/m$^2$), and 4-Hydroxy-6-methyl, 1,3,3a,7-teraazaindene stabilizer (102 mg/m$^2$) |
| Cellulose Acetate Support with RemJet Anti-halation backing |

Samples of each film element were given an appropriate stepped exposure to a light source with an effective color temperature of 5500 K and processed in the KODAK FLEXICOLOR (C-41) process as described in *British Journal of Photography Annual,* 1988, pp 196-198 to establish their respective initial performance. Following development, the optical image dye density was measured for each step of the stepwise exposure and the characteristic profile curve was generated for each sample. Gamma is the maximum slope between any two adjacent steps of the characteristic density curve. Results are listed in Table VIIb.

TABLE VIIb

Photographic Evaluation of Cyan Coupler Dispersions

| Sample | Dispersion | Dmin | Dmax | Gamma |
|---|---|---|---|---|
| 1 | A (Comp) | 0.094 | 1.14 | 1.11 |
| 2 | C (Inv) | 0.102 | 1.28 | 1.18 |
| 3 | J (Comp) | 0.087 | 1.25 | 1.12 |
| 4 | K (Comp) | 0.090 | 1.26 | 1.10 |

Sample 2 contains a dispersion that is 20% by weight of super solvent, N-butylacetanilide, relative to the weight of coupler. Addition of this relatively low amount of super solvent significantly increases the coupling activity as measured by gamma. Samples 3 and 4 contain dispersions that contain 50% and 100% by weight of the super solvent relative to the weight of coupler, respectively. Although these dispersions can be prepared at lower temperatures whit the higher levels of super solvent, the desirable increase in coupler activity is lost.

EXAMPLE 8

20.0 g of cyan coupler C1 was dissolved in 24.0 g of primary high-boiling solvent dibutylsebacate, which required heating to 160° C. to form comparison Solution A. 20.0 g of cyan coupler C1 was dissolved in 20.0 g of dibutylsebacate and 4.0 g of ethylbenzoate, which also required heating to 160° C. to form comparison Solution B. 20.0 g of cyan coupler C1 was dissolved in 20.0 g of dibutylsebacate and 4.0 g of N-butylacetanilide, which required heating to 110° C. to form inventive Solution C. 20.0 g of cyan coupler C1 was dissolved in 20.0 g of dibutylsebacate and 4.0 g of triethylphosphate, which also required heating to 110° C. to form inventive Solution D. Once dissolved, samples were taken after holding these solutions for 0, 30, and 60 min at the required temperatures. They were subsequently analyzed for coupler concentration (aim=100.0 area %) using High Performance Liquid Chromatography (HPLC). Results are summarized in Table VIII.

TABLE VIII

Effect of Temperature and Time on Coupler Concentration

| Solution | Temperature (° C.) | Time (min) | Area % Coupler C1 |
|---|---|---|---|
| A (Comp) | 160 | 0 | 95.3 |
| | 160 | 30 | 79.7 |
| | 160 | 60 | 66.9 |
| B (Comp) | 160 | 0 | 94.4 |
| | 160 | 30 | 76.7 |
| | 160 | 60 | 62.0 |
| C (Inv) | 110 | 0 | 99.3 |
| | 110 | 30 | 98.5 |
| | 110 | 60 | 97.9 |
| D (Inv) | 110 | 0 | 99.3 |
| | 110 | 30 | 99.0 |
| | 110 | 60 | 98.6 |

These results clearly show that the super-solvents of the present invention permit the use of lower oil phase solution temperatures, which result in substantially reduced coupler decomposition during oil phase preparation.

The preceding examples are set forth to illustrate specific embodiments of this invention and are not intended to limit the scope of the compositions, materials or methods of the invention. Additional embodiments and advantages within the scope of the claimed invention will be apparent to one skilled in the art.

What is claimed is:

1. A process for making a direct dispersion of a photographically useful material comprising: mixing (i) an aqueous phase and (ii) a liquid organic phase under conditions of shear or turbulence in the substantial absence of auxiliary solvent to form a direct dispersion of the organic phase dispersed in the aqueous phase; wherein the liquid organic phase comprises one or more photographically useful materials and one or more organic solvents having a boiling point of at least 150° C., a molecular weight less than or equal to 300, and a solvatochromic parameter β value greater than or equal to 0.50, and wherein the weight ratio of the sum of the solvents having a boiling point of at least 150° C., a molecular weight less than or equal to 300, and a solvatochromic parameter β value greater than or equal to 0.50 to the photographically useful materials does not exceed 0.25.

2. The process of claim 1, wherein the one or more organic solvents having a boiling point of at least 150° C., a molecular weight less than or equal to 300, and a solvatochromic parameter β value greater than or equal to 0.50 are selected from amides, anilides, phosphate esters, phosphine oxides, sulfoxides, ureas and ketones.

3. The process of claim 1, wherein the one or more organic solvents having a boiling point of at least 150° C., a molecular weight less than or equal to 300, and a solvatochromic parameter β value greater than or equal to 0.50 are selected from compounds of Formulas I through VI:

I

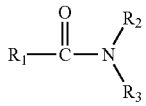

II

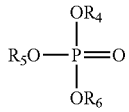

III

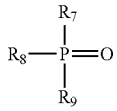

IV

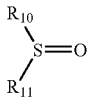

V

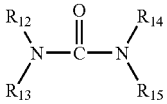

VI

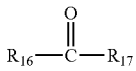

wherein $R_1$ through $R_{17}$ each independently represent hydrogen or a substituted or unsubstituted alkyl or aryl group.

4. The process of claim 3, wherein the liquid organic phase comprises a combination of organic solvents consisting essentially of one or more primary permanent high-boiling solvents and the one or more solvents having a boiling point of at least 150° C., a molecular weight less than or equal to 300, and a solvatochromic parameter β value greater than or equal to 0.50, where each primary solvent employed in the organic phase mixture of the dispersions has a boiling point of at least 150° C. and either (a) a molecular weight of greater than 300, (b) a solvatochromic parameter β value less than 0.50, or (c) a molecular weight of greater than 300 and a solvatochromic parameter β value less than 0.50, and where the weight ratio of the sum of the primary permanent solvents to the sum of the solvents having a boiling point of at least 150° C., a molecular weight less than or equal to 300, and a solvatochromic parameter β value greater than or equal to 0.50 is greater than 1.

5. The process of claim 4, wherein the photographically useful material comprises a dye image-forming coupler.

6. The process of claim 5, wherein the weight ratio of the sum of the primary permanent solvents to the sum of the solvents having a boiling point of at least 150° C., a molecular weight less than or equal to 300, and a solvatochromic parameter β value greater than or equal to 0.50 is at least 2.

7. The process of claim 5, wherein the weight ratio of the sum of the primary permanent solvents to the sum of the solvents having a boiling point of at least 150° C., a molecular weight less than or equal to 300, and a solvatochromic parameter β value greater than or equal to 0.50 is at least 3.

8. The process of claim 5, wherein the weight ratio of the sum of the primary permanent solvents to the sum of the solvents having a boiling point of at least 150° C., a molecular weight less than or equal to 300, and a solvatochromic parameter β value greater than or equal to 0.50 is at least 4.

9. The process of claim 5, wherein the weight ratio of the sum of the solvents having a boiling point of at least 150° C., a molecular weight less than or equal to 300, and a solvatochromic parameter β value greater than or equal to 0.50 to the photographically useful materials does not exceed 0.20.

10. The process of claim 5, wherein a primary solvent employed in the organic phase mixture of the dispersion is a phthalic acid alkyl ester, a phosphoric acid ester of molecular weight greater than 300, a citric acid ester, a benzoic acid ester, an aliphatic amide of molecular weight greater than 300, a mono or polyvalent alcohol of molecular weight greater than 300, or an aliphatic dioic acid alkyl ester.

11. The process of claim 5, wherein a primary solvent employed in the organic phase mixture of the dispersion is a phthalic acid alkyl ester, a phosphoric acid esters of molecular weight greater than 300, or an aliphatic dioic acid alkyl ester of the formula $R—(CH_2)_m—R'$ wherein R and R' each represent an alkoxycarbonyl group containing not more than 8 carbon atoms and m is an integer of from 1 to 10.

12. The process of claim 5, wherein the primary solvent comprises tricresylphosphate or dibutylsebacate.

13. The process of claim 5, wherein the weight ratio of dispersed coupler to primary solvents is from 0.1:1 to 10:1.

14. The process of claim 5, wherein the weight ratio of dispersed coupler to primary solvents is from 0.25:1 to 5:1.

15. The process of claim 5, wherein the weight ratio of dispersed coupler to primary solvents is from 0.25:1 to 2:1.

16. The process of claim 3, wherein $R_1$ through $R_{17}$ each independently represent a substituted or unsubstituted alkyl or aryl group.

17. The process of claim 3, wherein:

in Formula I, $R_1$ is alkyl or aryl, $R_2$ is alkyl, and $R_3$ is alkyl or aryl, wherein the total number of carbon atoms contained in $R_1$, $R_2$, and $R_3$ is less than 20;

in Formula II, $R_4$, $R_5$ and $R_6$ are alkyl or aryl, wherein the total number of carbon atoms contained in $R_4$, $R_5$, and $R_6$ is less than 15;

in Formula III, $R_7$, $R_8$ and $R_9$ are alkyl groups, and the total number of carbon atoms contained in $R_7$, $R_8$ and $R_9$ is less than 20;

in Formula IV, $R_{10}$ and $R_{11}$ are alkyl groups, wherein the total number of carbon atoms contained in $R_{10}$ and $R_{11}$ is less than 19;

in Formula V, $R_{12}$, $R_{13}$, $R_{14}$, and $R_{15}$ are alkyl or aryl, wherein the total number of carbon atoms contained in $R_{12}$, $R_{13}$, $R_{14}$, and $R_{15}$ is less than 20; and in Formula VI, $R_{16}$ and $R_{17}$ combine to form an aliphatic closed ring.

18. The process of claim 17, wherein the one or more organic solvents having a boiling point of at least 150° C., a molecular weight less than or equal to 300, and a solvatochromic parameter β value greater than or equal to 0.50 includes at least one compound of Formula I, where $R_1$ is a straight chain alkyl or aryl group, $R_2$ is a straight chain alkyl group, and $R_3$ is straight chain alkyl or aryl group, or $R_1$ combines with $R_2$ or $R_3$ to form a closed ring.

19. The process of claim 18, wherein the compound of Formula I is N,N-diethylbutyramide, N,N-diethyl-m-toluamide, N-butylacetanilide, or N-methylpyrrolidone.

20. The process of claim 17, wherein the one or more organic solvents having a boiling point of at least 150° C., a molecular weight less than or equal to 300, and a solvatochromic parameter β value greater than or equal to 0.50 includes at least one compound of Formula II, where $R_4$, $R_5$ and $R_6$ are alkyl groups.

21. The process of claim 20, where the compound of Formula II is trimethylphosphate or triethylphosphate.

22. The process of claim 17, wherein the one or more organic solvents having a boiling point of at least 150° C., a molecular weight less than or equal to 300, and a solvatochromic parameter β value greater than or equal to 0.50 includes at least one compound of Formula III.

23. The process of claim 22, wherein the compound of Formula III is trimethylphosphine oxide or triethylphosphine oxide.

24. The process of claim 17, wherein the one or more organic solvents having a boiling point of at least 150° C., a molecular weight less than or equal to 300, and a solvatochromic parameter β value greater than or equal to 0.50 includes at least one compound of Formula IV.

25. The process of claim 24, wherein the compound of Formula IV is dimethylsulfoxide or di-n-butylsulfoxide.

26. The process of claim 17, wherein the one or more organic solvents having a boiling point of at least 150° C., a molecular weight less than or equal to 300, and a solvatochromic parameter β value greater than or equal to 0.50 includes at least one compound of Formula V.

27. The process of claim 26, where the compound of Formula V is tetramethylurea or 1,3-dimethyl-1,3-diphenylurea.

28. The process of claim 17, wherein the one or more organic solvents having a boiling point of at least 150° C., a molecular weight less than or equal to 300, and a solvatochromic parameter β value greater than or equal to 0.50 includes at least one compound of Formula VI.

29. The process of claim 28, where the compound of Formula VI is cyclohexanone or cyclopentanone.

30. The process of claim 1, wherein the weight ratio of the sum of the solvents having a boiling point of at least 150° C., a molecular weight less than or equal to 300, and a solvatochromic parameter β value greater than or equal to 0.50 to the photographically useful materials does not exceed 0.20.

31. The process of claim 1, wherein the photographically useful material comprises a dye image-forming coupler.

32. The process of claim 1, wherein the liquid organic phase comprises one or more photographically useful materials and one or more organic solvents having a boiling point of at least 150° C., a molecular weight less than or equal to 250, and a solvatochromic parameter β value greater than or equal to 0.50, and wherein the weight ratio of the sum of the solvents having a boiling point of at least 150° C., a molecular weight less than or equal to 250, and a solvatochromic parameter β value greater than or equal to 0.50 to the photographically useful materials does not exceed 0.25.

33. The process of claim 1, wherein the liquid organic phase comprises one or more photographically useful materials and one or more organic solvents having a boiling point of at least 150° C., a molecular weight less than or equal to 300, and a solvatochromic parameter β value greater than or equal to 0.60, and wherein the weight ratio of the sum of the solvents having a boiling point of at least 150° C., a molecular weight less than or equal to 300, and a solvatochromic parameter β value greater than or equal to 0.60 to the photographically useful materials does not exceed 0.25.

34. The process of claim 1, wherein the liquid organic phase comprises one or more photographically useful materials and one or more organic solvents having a boiling point of at least 150° C., a molecular weight less than or equal to 300, and a solvatochromic parameter β value greater than or equal to 0.70, and wherein the weight ratio of the sum of the solvents having a boiling point of at least 150° C., a molecular weight less than or equal to 300, and a solvatochromic parameter β value greater than or equal to 0.70 to the photographically useful materials does not exceed 0.25.

35. A direct dispersion obtained by the process of claim 1.

36. A photographic element comprising one or more light sensitive silver halide emulsion imaging layers having associated therewith a direct dispersion obtained by the process of claim 1, wherein the coated level of solvents having a boiling point of at least 150° C., a molecular weight less than or equal to 300, and a solvatochromic parameter β value greater than or equal to 0.50 in any layer of the element is no greater than 200 $mg/m^2$.

* * * * *